US009978232B2

(12) United States Patent
Weusten et al.

(10) Patent No.: US 9,978,232 B2
(45) Date of Patent: May 22, 2018

(54) ANTI-THEFT SECURITY SYSTEM FOR ELECTRICAL APPLIANCES

(71) Applicant: Mobile Tech, Inc., Lake Oswego, OR (US)

(72) Inventors: Leo Hendrik Marie Weusten, Badhoevedorp (NL); Rogier Christian Van Baar, Badhoevedorp (NL)

(73) Assignee: Mobile Tech, Inc., Lake Oswego, OR (US)

( * ) Notice: Subject to any disclaimer, the term of this patent is extended or adjusted under 35 U.S.C. 154(b) by 0 days. days.

(21) Appl. No.: 15/346,381

(22) Filed: Nov. 8, 2016

(65) Prior Publication Data

US 2017/0116832 A1 Apr. 27, 2017

Related U.S. Application Data

(63) Continuation of application No. PCT/EP2014/059457, filed on May 8, 2014.

(51) Int. Cl.

| | |
|---|---|
| ***G08B 13/12*** | (2006.01) |
| ***G08B 13/14*** | (2006.01) |
| ***H01R 13/66*** | (2006.01) |
| ***H01R 25/00*** | (2006.01) |

(52) U.S. Cl.

CPC ..... *G08B 13/1409* (2013.01); *H01R 13/6683* (2013.01); *H01R 25/003* (2013.01)

(58) Field of Classification Search

CPC ..... G01B 11/0691; G08B 13/1409; G01N 21/3563; H01R 13/6683; H01R 25/003

USPC ..... 340/568.2, 568.3, 568.4

See application file for complete search history.

(56) References Cited

U.S. PATENT DOCUMENTS 5,021,940 A * 6/1991 Cox ..... A23N 17/005 241/34
5,525,965 A 6/1996 Liebenthal
6,148,258 A * 11/2000 Boisvert ..... F02P 19/022 123/145 A
6,150,940 A 11/2000 Chapman
(Continued)

FOREIGN PATENT DOCUMENTS

EP 0218281 B1 4/1987
WO 2011133578 A1 10/2011

OTHER PUBLICATIONS

International Search Report and Written Opinion for International patent application No. PCT/EP2014/059457, dated Feb. 2, 2015.

*Primary Examiner* — Ojiako Nwugo
(74) *Attorney, Agent, or Firm* — Berkeley Law & Technology Group, LLP

(57) ABSTRACT

A power strip for use in an anti-theft security system and an anti-theft security system for electrical appliances includes a socket-outlet for receiving a power plug that is electrically connected to a power cord for an electrical appliance. The power strip comprises an electronic circuit configured to measure a first electrical characteristic of the power cord and/or the electrical appliance when the power plug is inserted into the socket-outlet and to measure a second electrical characteristic of the power cord and/or the electrical appliance while the power plug is inserted. A change between the first measurement result and the second measurement results in triggering an alarm.

29 Claims, 5 Drawing Sheets

(56) References Cited

U.S. PATENT DOCUMENTS

| | | | | |
|---|---|---|---|---|
| 8,165,832 | B1 * | 4/2012 | Low | G01R 21/133 702/60 |
| 8,221,154 | B1 * | 7/2012 | Paquette | H01R 13/665 439/488 |
| 8,461,725 | B1 * | 6/2013 | Stubbs | H01H 9/54 307/140 |
| 9,318,857 | B2 * | 4/2016 | Soneda | G01R 33/07 |
| 2008/0053847 | A1 * | 3/2008 | Rakosky | B25H 3/02 206/216 |
| 2011/0062792 | A1 * | 3/2011 | Okazaki | H02J 9/005 307/116 |
| 2011/0298301 | A1 | 12/2011 | Wong | |
| 2012/0043813 | A1 * | 2/2012 | Doi | H02J 3/00 307/39 |
| 2012/0185185 | A1 * | 7/2012 | Bae | H04Q 9/00 702/58 |
| 2013/0265164 | A1 * | 10/2013 | Brown | G08B 13/14 340/568.2 |
| 2014/0115367 | A1 * | 4/2014 | Soda | H04N 1/00204 713/323 |

* cited by examiner

ANTI-THEFT SECURITY SYSTEM FOR ELECTRICAL APPLIANCES

FIELD OF THE INVENTION

The present invention relates to anti-theft security systems for electrical appliances and more particularly to a power strip for use in an anti-theft security system for electrical appliances.

BACKGROUND

To prevent retail electrical appliances being stolen, an electrical appliance may be secured to the display or counter where it is displayed.

Securing the appliance with a cable chain lock allows a customer to hold and possibly try the appliance whilst preventing the appliance from being taken away. Such cable chain is relatively easy to cut and no alarm would be triggered by doing so, making this solution less favorable.

Alternatively, the appliance may be secured to an alarm system using a dedicated alarm cable. In such security system, one end of the alarm cable is attached to the appliance, for example by looping the alarm cable through an opening in the appliance. The other end of the cable is provided with a plug to attach the cable to the alarm system via a dedicated alarm socket. As with the cable chain lock, this solution allows a customer to hold and possibly try the appliance whilst preventing the appliance from being taken away. Removing the cable from the alarm system or cutting the cable triggers an alarm. Often dedicated alarm cables are found to be aesthetically undesired. Furthermore, dedicated alarm sockets are to be installed for receiving the alarm cables, which can be costly.

EP218281B1 discloses an anti-theft security system for electrical appliances to be connected by means of wall mounted socket-outlets to a power supply system. The electrical appliance is prevented from being stolen by inserting its power cable into the wail mounted socket and detecting the pins of the power plug being removed from the socket when the plug is removed from the socket. Disadvantageously, the electrical appliance may still be taken away without triggering the alarm, as long as the plug remains inserted in the socket.

There is a need for an improved anti-theft security system for electrical appliances that overcomes the above identified drawbacks of the prior art.

SUMMARY OF THE INVENTION

According to an aspect of the invention a power strip is proposed for use in an anti-theft security system for electrical appliances. The power strip can comprise a socket-outlet for receiving a power plug that is electrically connected to a power cord for an electrical appliance. The power strip can comprise an electronic circuit and a memory. The electronic circuit can be configured to measure a first electrical characteristic of the power cord and/or the electrical appliance when the power plug is inserted into the socket-outlet to obtain a first measurement result. The electronic circuit can further be configured to store the first measurement result in the memory. The electronic circuit can further be configured to measure a second electrical characteristic of the power cord and/or the electrical appliance while the power plug is inserted into the socket-outlet to obtain a second measurement result. The electronic circuit can further be configured to compare the first measurement result with the second measurement result to detect a changed electrical characteristic.

The detected changed electrical characteristic provides an indication that the power plug, power cable or appliance has been tampered with. Advantageously it can thus be detected when the power plug is removed from the socket-outlet, when the power cord is cut or when the power cable is removed from the appliance. The power cord itself functions as alarm cable; there is no need for an additional dedicated alarm cable or cable chain lock.

The anti-theft security system may consists of the power strip only, may contain two or more power strips and may include a computer implemented server communicatively connected to one or more power strips.

The power strip is particularly suitable for use in stores, but may alternatively be used in other settings, such as home environments for securing personal appliances or hospitals for securing hospital equipment.

An example embodiment advantageously enables reliable and accurate measurement of the electrical characteristic. The capacitance and/or the induction need not be measured directly, but may be measured indirectly. An example of an indirect measurement involves an oscillator circuit producing an oscillation signal depending on a change in capacitance or induction, the frequency of which is indicative, of the capacitance or induction of the power cable and/or appliance.

An example embodiment advantageously enables limited access to the power strip and/or logging who uses the power strip.

An example embodiment advantageously enables audible and/or visual alarms to go off. The visual indicator may advantageously be used to indicate that a socket-outlet is in use or powered.

An example embodiment advantageously enables multiple socket-outlets to be uniquely identifiable, which is particularly useful for data logging purposes.

An example embodiment advantageously enables measurements to start only after a power plug is inserted in a socket-outlet. Thus, when no power plug is inserted no measurements will be performed, thereby limiting energy use.

An example embodiment advantageously enables detection of a movement of the power strip. This reduces the risk of someone taking the appliance together with the power strip without removing the power cable.

An example embodiment advantageously enables the electronics in the power strip to be powered without battery, avoiding the risk of an empty battery. It is possible that the external power source is used for powering the electronic circuit only, i.e. no power is provided to the socket-outlet and the electrical appliance does not receive power. In this configuration the power strip may be called a non-powered version of the power strip. It is possible that the external power source is used for powering the electronic circuit and the socket-outlet. In the latter configuration the electrical appliance may be powered and turned on, and the power strip may be called a powered version of the power strip. It is possible to selectively power one or more socket-outlets in a power strip.

An example embodiment advantageously enables a temporary backup power for powering the electronics in the power strip in case of a power drop or loss in the external power source.

An example embodiment advantageously enables the power strip to be also used for powering the electrical appliance. The power strip in this configuration may be called a powered-version of the power strip. It is possible to selectively power one or more socket-outlets in a power strip.

An example embodiment advantageously enables the power strip to be used as an anti-theft device only. In this configuration the power strip may be called a non-powered version of the power strip.

According to an aspect of the invention an anti-theft security system for electrical appliances is proposed. The security system comprising a power strip having one or more of the above described features. The security system further comprises a computer implemented server. The power strip further comprises a network interface for communicatively connecting the power strip to the server. The power strip can be configured to transmit an alarm signal triggered by the changed electrical characteristic to the server via the network interface. The power strip can be configured to transmit an indication of the changed electrical characteristic to the server via the network interface.

The server may advantageously be used to monitor the power strip, alarms triggered by the power strip and the cause of the alarm signals.

An example embodiment advantageously enables individual socket-outlets to be powered from the server. Thus, electrical appliances can be turned on and off remotely from the server.

Hereinafter, embodiments of the invention will be described in further detail. It should be appreciated, however, that these embodiments may not be construed as limiting the scope of protection for the present invention.

BRIEF DESCRIPTION OF THE DRAWINGS

Aspects of the invention will be explained in greater detail by reference to exemplary embodiments of the invention shown in the drawings, in which.

DETAILED DESCRIPTION OF THE DRAWINGS

A power strip, which is also known as an extension block, power board, power bar, plug board or trailer lead, is a block of electrical sockets that attaches to the end of a power cord of an electrical appliance or device. The power strip typically allows multiple electrical appliances to be powered from an external power source connected to the power strip. Power strips are often used when multiple electrical appliances are in proximity.

The power cord that attached the electrical appliance to the power strip is a cable that is usually used to temporarily connect the appliance to the mains electricity supply. The cable typically uses a power plug in conformance with CEE 7, NEMA 5 or any other applicable standard depending on the country, to connect to a single-phase alternating current power source at the local line voltage of 100 to 240 volts, depending on the location. Power cords may be fixed to or detachable from the appliance. In the case of detachable leads, the appliance end of the power cord has a female connector, typically in conformance with IEC 60320 to link to the appliance, to avoid the dangers from having a live protruding pin.

Figure 1A:
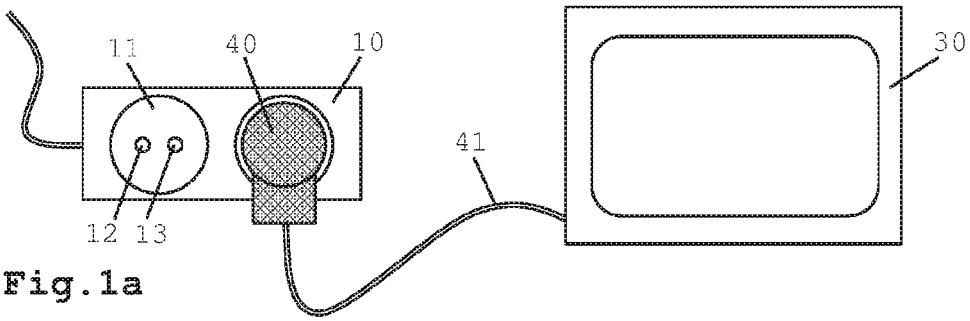
FIGS. 1*a*-1*d* show a power strip, a power cable and an electrical appliance in different connection scenarios.
Figure 8:
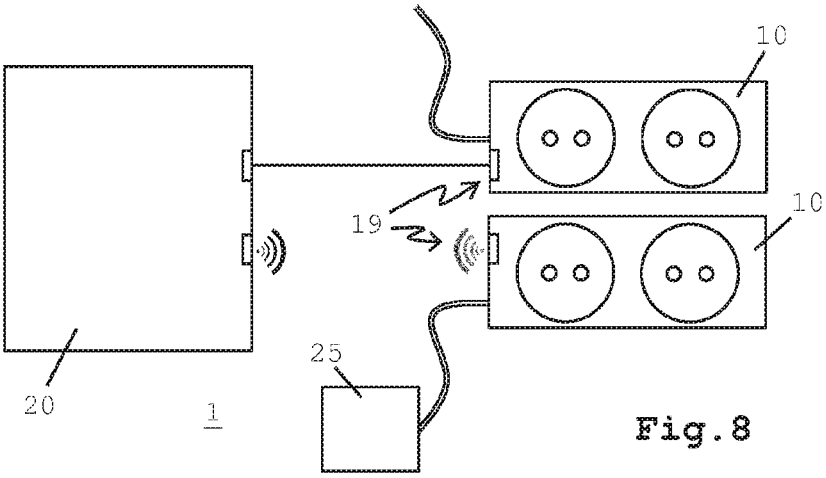
FIG. 8 shows an anti-theft security system.

FIG. 1*a* shows an exemplary power strip 10 of the present invention. The power strip 10 has one or more socket-outlets 11 for receiving a power cord 41 via the attached power plug 40. In the example of FIG. 1*a* the power strip has two socket-outlets 11. The power strip 10 may look like and function as an ordinary power strip as described above, but is adapted to function in an anti-theft security system, an example of which is shown in FIG. 8. Advantageously, the standard power cord 41 of the electrical appliance 30 may be used for securing the appliance 30 to the security system, i.e. no dedicated alarm cable is required. The power strip 10 may be used to secure the appliance 30 to the security system without actually providing power to the appliance. In this case the power strip 10 and power cord 41 are used for anti-theft only. Alternatively the power strip 10 may be used to secure the appliance 30 to the security system with the possibility of also powering the appliance 30.

The power strip 10 is adapted to measure an electrical characteristic of the power cord 41 and/or the attached electrical appliance 30 via two pins 43,44 (see FIG. 1*d*) of the power plug 40 when inserted into a socket-outlet 11 of the power strip 10. The electrical characteristic may be a parallel capacitance of the power cord 41 measured via two pins 43,44 of the power plug 40 when inserted into the socket-outlet 11 of the power strip 10. Alternatively or additionally the electrical characteristic may be an electromagnetic induction measured via the two pins 43,44 of the potter plug 40 when inserted into the socket-outlet 11. Measuring the electromagnetic induction typically involves an electronic circuit within the electrical appliance 30 attached to the power cord 41.

Figure 1B:
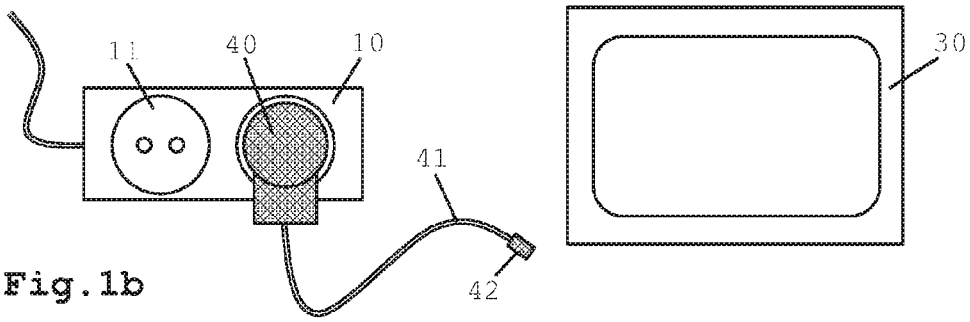
Figure 1C:
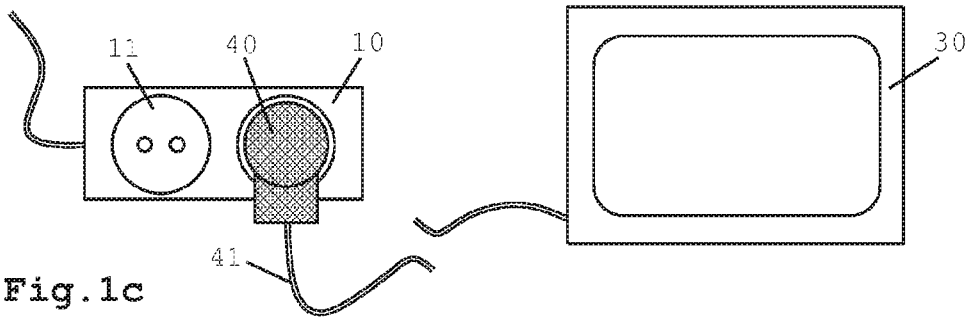
Figure 1D:
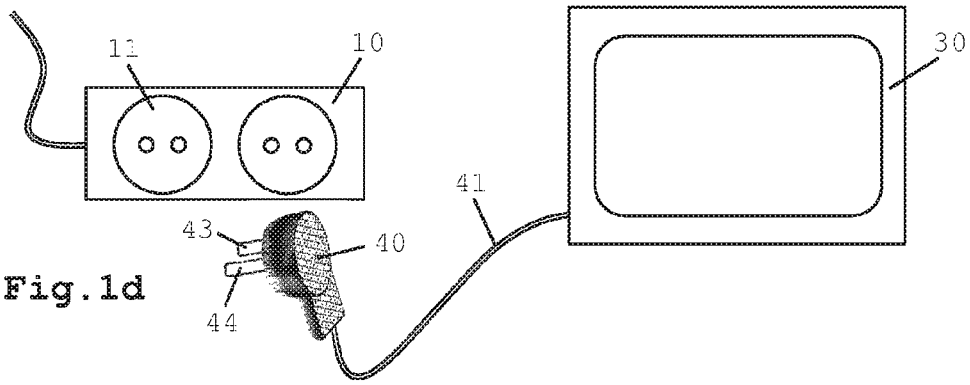

The thus measured electrical characteristic or characteristics of the power cable 41 and/or the electrical appliance 30 is used to detect the power cord 41 being removed from the appliance 30, such as shown in FIG. 1*b*, to detect the power cord 41 being cut, such as shown in FIG. 1*c*, or to detect the power cord 41 being removed from the power strip 10, such as shown in FIG. 1*d*. Upon such detection an alarm may be triggered.

Figure 2:
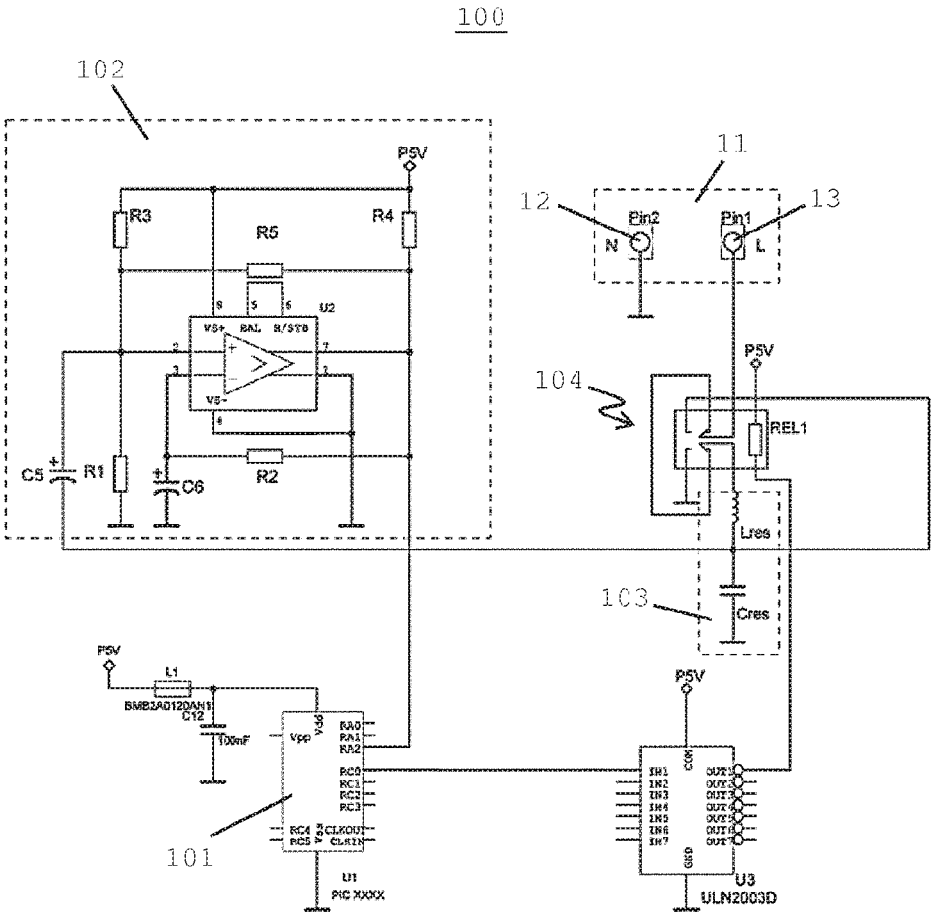
FIG. 2 shows an electronic circuit for use in a power strip.

Within the housing of the power strip 10 an electronic circuit 100, such as shown in FIG. 2, is used to measure the electrical characteristics of the power cable 41 and/or the appliance 30. The power cable 41 connects to the electronic circuit 100 by inserting the power plug 40 into the socket-outlet 11. More specifically, pins 43,44 of the power plug 40 connect to pin sockets Pin1,Pin2 when inserted through pin holes 12,13 of the socket-outlet 11. Pin2 is connected to ground making that pin the neutral pin (depicted as "N" next to Pin2). Pin1 is connected to the measurement circuit making that pin the live pin (depicted as "L" next to Pin1).

In the exemplary embodiment of FIG. 2 the electronic circuit 100 contains parts with different functions. The actual implementation of the electronic circuit 100 may be different from the one shown in FIG. 2, as long as the functionality of measuring the electrical characteristic(s) of the power cable 41 and/or the appliance 30 is provided. Microcontroller U1, e.g. a PIC xxxx type of microcontroller, controls switch circuit 104 via output port RC0 and receives measurement results from oscillator circuit 102 via input port RA2. A Darlington Array U3, e.g. of the type ULN2003D, may be used to amplify the signal from the microcontroller U1 to the switch circuit 104. As an alternative to the Darlington Array U3 a FET or any other known electronics may be used for this function. The switch circuit 104 switches between measuring a parallel capacitance and an electromagnetic induction using relay REL1.

In the configuration of FIG. 2 the switch circuit 104 is set to measure an electromagnetic induction, wherein induction $L_{res}$ of resonant circuit 103 is added to the induction L (not to be confused with live pin L) of the connected power cord 41 and/or appliance 30 by connecting $L_{res}$ and L in series. Switching relay REL1 would result in measuring a parallel capacitance, wherein capacitance $C_{res}$ of resonant circuit 103 is added to the capacitance C of the connected power cord 41 and/or appliance 30 by connecting $C_{res}$ and C in parallel.

The output of the resonant circuit 103 is fed to the oscillator circuit 102. The output of the resonant circuit 103 is fed to the microcontroller U1, where the input frequency on port RA2 results in a 16-bit counter to be activated. The microcontroller U1 reads the counter value of the 16-bit counter at fixed time intervals. The increase of the counter value in the time interval provides an indication of the measured frequency, which is stored in a memory 101 of the microcontroller U1. The memory 101 is for example an eeprom.

FIG. 2 shows various components which will not be described in more detail. The meaning and function of these components in the electronic circuit 100 will be understood by the skilled person. These components are capacitors C5, C6 and C12, inductor L1, resistors R1, R2, P3, R4 and R5, and integrated circuit U2.

Figure 3:
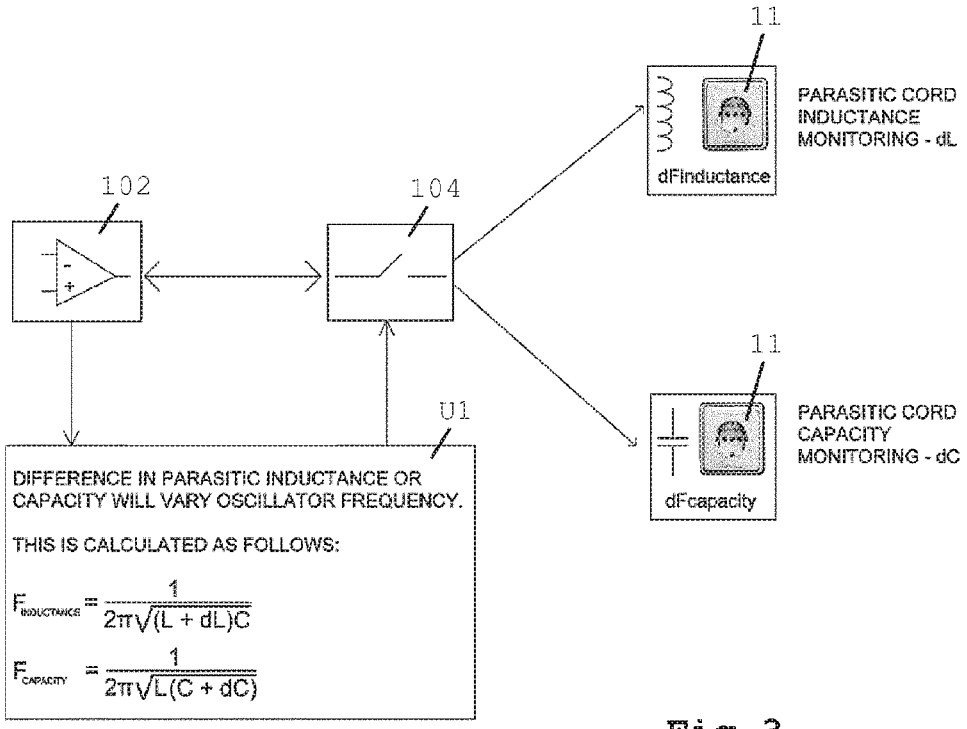
FIG. 3 is a functional overview of an electronic circuit in a power strip.

FIG. 3 gives a high level overview of the function of the electronic circuit 100. Microcontroller U1 controls the switch 104 to switch between measuring the parasitic cord, inductance, and the parasitic cord capacitance. In the inductance setting the inductance is monitored and a change in inductance dL may be detected. In the capacitance setting the capacitance is monitored and a change in capacitance dC may be detected. Via oscillator circuit 102 the microcontroller U1 determines a value indicative of the parasitic inductance or capacity expressed as a frequency obtained using the counter as described with FIG. 2. A change in inductance dL thus results in a change in frequency (depicted $dF_{inductance}$) and a change in capacitance dC thus results in a change in frequency (depicted $dF_{capacity}$). The oscillator frequency, which is input to the microprocessor U1, depends on the inductance of $L_{res}$, the capacitance of $C_{res}$ and the change in parasitic cord inductance dL or change in parasitic cord capacitance dC, depending on the setting of the switch. When measuring the inductance, the oscillator frequency will be as follows: $F_{inductance}=1/(2n\sqrt{((L+dL)C)})$, wherein L is the value of $L_{res}$, C is the value of $C_{res}$ and dL is a change in inductance on the power cable 41 and/or appliance 30. When measuring the capacitance, the oscillator frequency will be as follows: $F_{capacitance}=1/(2n\sqrt{(L(C+dC))})$, wherein L is the value of $L_{res}$, C is the value of $C_{res}$ and dC is a change in capacitance on the power cable 41 and/or appliance 30.

A change in capacitance and/or inductance may be caused by inserting the power plug 40 into the socket-outlet 11, such as shown in FIG. 1*a*. The thus measured electrical characteristic, the value of which is expressed and stored as a frequency in the microprocessor U1, gives a first or initial measurement result. A subsequent change in capacitance and/or inductance may be caused by unplugging the power cord 41 from the appliance 30, such as shown in FIG. 1*b*, cutting the power cord 41, such as shown in FIG. 1*c*, or unplugging the power plug 40, such as shown in FIG. 1*d*. The then measured electrical characteristic, again expressed as a frequency, will differ from the first or initial measurement result. The microprocessor U1 is configured to detect such change in measurement results for triggering an alarm.

Measuring the inductance instead of the capacitance may be advantageous when the connected appliance does not short circuit the power cord 41. This may be the case when the applicant has a mechanical switch for switching of the appliance. When switched off, the circuit is open without any electronics in between the leads of the power cord 41.

The microcontroller U1 may be configured to ignore small variations in inductance or capacitance (i.e. in the frequency indicative of the inductance of capacitance). This may avoid false alarms. The microcontroller U1 may be configured to get a first initial measurement result when the power plug 40 is inserted into the socket-outlet 11 while the appliance 30 is unplugged on the other end of the power cord 41 and get a second initial measurement result when the power cord 41 is plugged into the appliance 30. The difference between the first initial measurement result and the second initial measurement result may then be used as a threshold value in a subsequent detected change in the electrical characteristic for triggering the alarm.

Measurements may be performed continuously or at predefined time intervals.

In an embodiment the power strip 10 is used as an anti-theft device only. Such power strip may be called a non-powered version of the power strip. In this configuration no power is provided to the socket-outlet 11 and as a result the appliance 30 cannot be powered. In another embodiment the power strip 10 is used as an anti-theft device and may provide power to one or more of the socket-outlets 11. Such power strip may be called a powered version of the power strip. In this configuration the appliance 30 can be powered and used. In an embodiment power to individual socket-outlets may be turned on and off.

In an exemplary embodiment a non-powered power strip is configured to perform the following functions. Typically these functions are configured or programmed in the microcontroller U1. Upon insertion of the power plug 40 into the socket-outlet 11 an initial capacitance measurement is performed and the frequency value indicative of the capacitance measurement is stored in the memory 101. Next, the capacitance is continuously measured and upon detection of a change in the capacitance an inductance measurement is performed. If an inductance can be measured, i.e. a frequency is detected, then the appliance 30 is still connected and no alarm is triggered. The change in capacitance was then typically cause by pressing a button on the appliance 30. In this case, the non-powered power strip starts measuring the capacitance again and functions as described. If no inductance can be measured, i.e. the detected frequency is zero, then the appliance 30 is probably removed and an alarm may be triggered.

In an exemplary embodiment a powered power strip is configured to perform the following functions. Typically these functions are configured or programmed in the microcontroller U1. With the appliance 30 being powered, an electrical current can be measured on the pin sockets Pin1, Pin2. The measurable current is typically in a range between a standby current (i.e. the current used when the appliance 30 is in standby mode) and an in-use current (i.e. the current used when the appliance 30 is turned on). When the current drops to zero or no current is measurable initially, this may be caused by the appliance 30 being turned off (i.e. completely turned off, not in standby mode) or taken away. The power to the socket-outlet may then be turned off.

In case the appliance 30 was turned off, the powered power strip may operate as follow. Upon detection of the current drop or when no current is measurable, a capacitance measurement is performed and the frequency value indicative of the capacitance measurement is stored in the memory 101. The capacitance is continuously measured and upon detection of a change in the capacitance an inductance measurement is performed. If an inductance can be measured, i.e. a frequency is detected, then the appliance 30 is still connected and no alarm is triggered. The change in capacitance was then typically causes by pressing an on-button on the appliance 30, i.e. turning on the appliance 30. The power to the socket-outlet may then be turned on. Next, the electrical current is monitored and the powered power strip functions as described above again.

In case the appliance 30 was taken away, the powered power strip may operate as follow. Upon detection of the current drop or when no current is measurable, a capacitance measurement is performed. If no measurement result can be obtained, i.e. the detected frequency is zero, an inductance measurement is performed. If no inductance can be measured, i.e. the detected frequency is zero, then it may be concluded that the appliance 30 is taken away and an alarm may be triggered.

Measurements are typically performed for each socket-outlet 11 individually and the measurement results are typically stored in the memory 101 for all socket-outlets 11. Each socket-outlet may be assigned an identifier to distinguish the stored. measurements results in the memory 101.

The first or initial measurement may be triggered by first insertion of the power plug 40 into the socket-outlet 11. A detection means, depicted as 16 in FIG. 4, may be used to detect that the power plug 40 is inserted in the socket-outlet 11. The detection means 16 may be implemented in various manners, such as a light sensor being blocked by a pin 43,44 when inserted into a pin socket 12,13 or a dip switch being activated upon insertion of a pin 43,44 into a pin socket 12,13.

Figure 5:
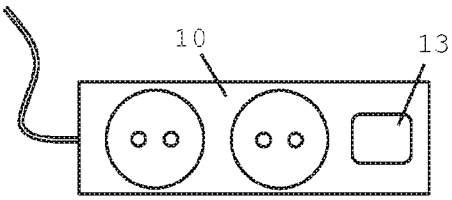

The power strip 10 may include an identity reader 13, such as shown in FIG. 5. The identity reader 13, such as an RFID tag reader, NFC reader or a fingerprint reader, may be used to allow only authorized personnel to activate the power strip 10. It may also enable removal of a power plug 40 or appliance 30 without triggering an alarm. Furthermore, the identity read by the identity reader 13 may be stored in a memory in the power strip 10 for later reference. Thus it may be determined at a later moment who used the power strip 10.

Figure 6:
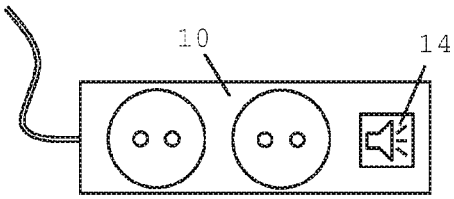
Figure 7:
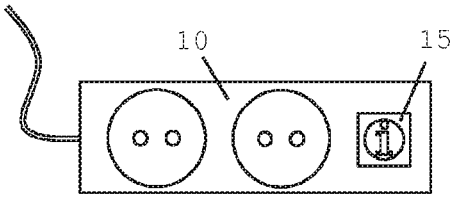

The power strip 10 may include a speaker 14, such as shown in FIG. 6, for sounding an alarm when triggered by the measurement of the electrical characteristics of the power cable 41 and/or appliance 30. The power strip 10 may include a visual indicator 15, such as shown in FIG. 6, for displaying an alarm signal when triggered by the measurement of the electrical characteristics of the power cable 41 and/or appliance 30. The visual indicator 15 is e.g. an LED or display.

Figure 4:
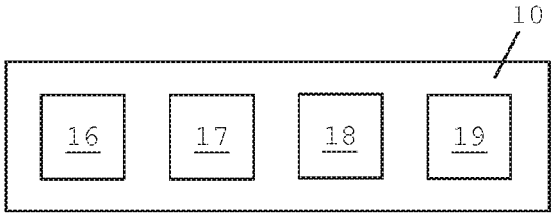
FIGS. 4-7 show optional elements in a power strip.

The power strip 10 may include a motion detector 17, such as shown in FIG. 4, for detecting the power strip 10 being moved. The motion detector 17 is e.g. a three-axis electronic gyroscope. Taking away the appliance 30 and the power strip 10 whilst leaving the power cord 41 connected may then still trigger an alarm.

The power strip 10 is typically connected to an external power source 25, such as shown in FIG. 8. The external power source powers the electronic circuit 100 and optionally provides power to the socket-outlet 11 for powering the appliance 30.

A battery 18, such as shown in FIG. 4, may be part of the power strip 10 to temporary power the electronic circuit when the external power source 25 is not available.

FIG. 8 shows an anti-theft security system 1 of an exemplary embodiment of the invention. In the anti-theft security system 1 one or more power strips 10 are connected to an external server 20 via a network interface 19. The network interface may be a wired network interface, such as in the top power strip, or a wireless network interface, such as in the bottom power strip. The server may receive alarm signals, measurement results, identity information received via identity reader 13 and/or any other data from the power strip 10. Thus, the server 20 may keep track of the working of the power strip 10.

The server 20 may be configured to selectively enable or disable power to socket-outlets 11 for powering connected appliances 30.

Figure 9:
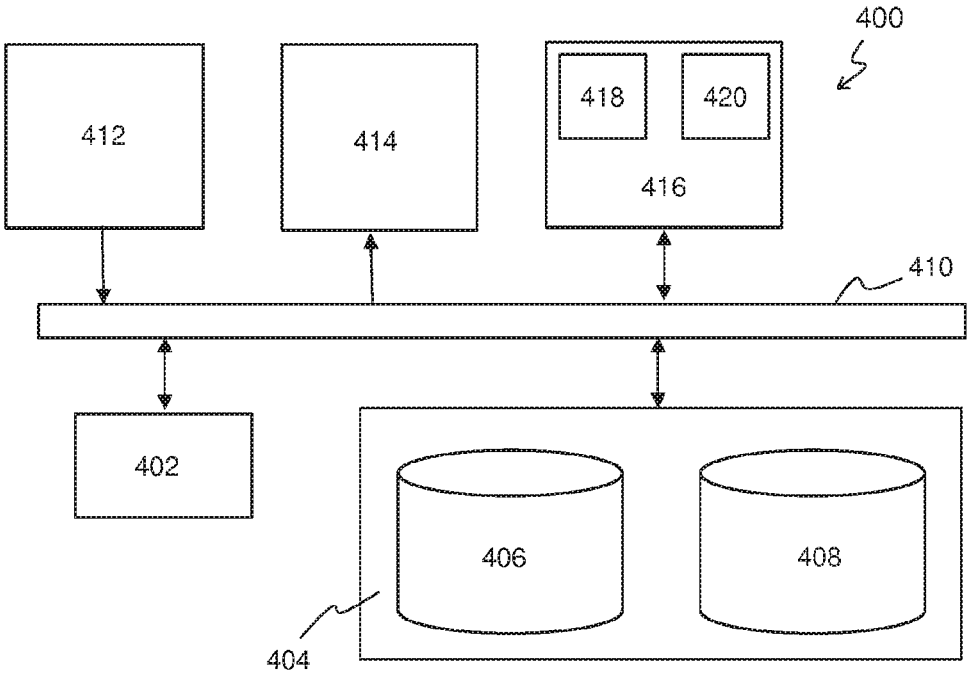
FIG. 9 shows a computer architecture.

FIG. 9 shows a block diagram illustrating an exemplary computer system 400, according to one embodiment of the present disclosure. A computer system 400 may be used to provide computer processing capabilities to the server 20 or to the power strip 10, e.g. for processing and storing identity data received via the identity reader 13.

Computer system 400 may include at least one processor 402 coupled to memory elements 404 through a system bus 410. The processor 402 typically comprises a circuitry and may be implemented as a microprocessor. As such, the computer system may store program code within memory elements 404. Further, processor 402 may execute the program code accessed from memory elements 404 via system bus 410. In one aspect, computer system 400 may be implemented as a computer that is suitable for storing and/or executing program code. It should be appreciated, however, that system 400 may be implemented in the form of any system including a processor and memory that is capable of performing the functions described within this specification.

Memory elements 404 may include one or more physical memory devices such as, for example, local memory 406 and/or one or more bulk storage devices 408. Local memory may refer to random access memory or other non-persistent memory device(s) generally used during actual execution of the program code. A bulk storage device may be implemented as a hard drive or other persistent data storage device. The computer system 400 may also include one or more cache memories (not shown) that provide temporary storage of at least some program code in order to reduce the number of times program code must be retrieved from bulk storage device 408 during execution.

Input/output (I/O) devices, depicted as input device 412 and output device 414 optionally can be possibly wirelessly, coupled to the data processing system. Examples of input devices may include, but are not limited to, for example, a keyboard, a pointing device such as a mouse, identity reader 13, or the like. Examples of output devices may include, but are not limited to, for example, a monitor or display, speakers, or the like. Input device and/or output device may be coupled to computer system 400 either directly or through intervening I/O controllers. A network adapter 416 may also be coupled to computer system 400 to enable it to become coupled to other systems, computer systems, remote network devices, and/or remote storage devices through intervening private or public networks. The network adapter may, in particular, comprise a data receiver 418 for receiving data that is transmitted by said systems, devices and/or networks to said data and a data transmitter 420 for transmitting data to said systems, devices and/or networks.

Modems, cable modems, and Ethernet cards are examples of different types of network adapter that may be used with computer system 400.

The memory elements 404 may store an application (not shown). It should be appreciated that computer system 400 may further execute an operating system (not shown) that can facilitate execution of the application. Application, being implemented in the form of executable program code, can be executed by computer system 400, e.g., by processor 402. Responsive to executing application, computer system 400 may be configured to perform one or more of the operations of the server 20 or the power strip 10.

What is claimed is:

1. A power strip for use in an anti-theft security system for electrical appliances, the power strip comprising:

a socket-outlet configured to receive a power plug that is electrically connected to a power cord for an electrical appliance, wherein the power strip comprises an electronic circuit and memory, wherein the electronic circuit is configured to:

measure a first electrical characteristic of the power cord and/or the electrical appliance while the power plug is inserted into the socket-outlet to obtain a first measurement result;

store the first measurement result in the memory;

measure a second electrical characteristic of the power cord and/or the electrical appliance while the power plug is inserted into the socket-outlet to obtain a second measurement result; and compare the first measurement result with the second measurement result to detect a changed electrical characteristic; and an identity reader, wherein the power strip is configured to place the socket-outlet in an active mode after receiving identity data via the identity reader, and wherein the power strip is configured to store the identity data in the memory.

2. The power strip according to claim 1, wherein the changed electrical characteristic includes a parallel capacitance measurement measurable via two pins of the power plug while the power plug is inserted into the socket-outlet.

3. The power strip according to claim 1, further comprising a speaker electrically connected to the electronic circuit configured to produce an alarm sound triggered by the detected changed electrical characteristic.

4. The power strip according to claim 1, wherein the electronic circuit is configured to store the first measurement result together with a socket-outlet identifier in the memory.

5. The power strip according to claim 4, wherein the socket-outlet comprises a plurality of the socket-outlets, a particular socket-outlet having a corresponding socket-outlet identifier.

6. The power strip according to claim 1, further comprising a detector configured to detect an insertion of the power plug into the socket-outlet.

7. The power strip according to claim 6, wherein the electronic circuit is configured to facilitate measuring the first electrical characteristic upon detection of the insertion of the power plug into the socket-outlet.

8. The power strip according to claim 1, wherein the power strip is configured to connect to an external power source to power the electronic circuit.

9. The power strip according to claim 8, wherein the power strip further comprises a battery configured to power the electronic circuit while the external power source is unavailable.

10. The power strip according to claim 8, wherein the power strip is configured to power the socket-outlet with power received from the external power source for powering a connected electrical appliance.

11. The power strip according to claim 1, further comprising a visual indicator configured to output an alarm signal triggered by the detected changed electrical characteristic and/or for indicating that the socket-outlet is in use.

12. The power strip according to claim 1, further comprising:

an alarm that is triggered based, at least in part, on the detected changed electrical characteristic.

13. The power strip according to claim 12, wherein the alarm is triggered based, at least in part, on the detected changed electrical characteristic as compared to a threshold value.

14. An anti-theft security system for electrical appliances, the security system comprising:

a power strip comprising:

a socket-outlet configured to receive a power plug that is electrically connected to a power cord for an electrical appliance, wherein the power strip comprises an electronic circuit and memory, wherein the electronic circuit is configured to:

measure a first electrical characteristic of the power cord and/or the electrical appliance while the power plug is inserted into the socket-outlet to obtain a first measurement result;

store the first measurement result in the memory;

measure a second electrical characteristic of the power cord and/or the electrical appliance while the power plug is inserted into the socket-outlet to obtain a second measurement result; and compare the first measurement result with the second measurement result to detect a changed electrical characteristic; and a computer implemented server configured to transmit an on/off signal to the power strip for selectively enabling the socket-outlet to be powered, wherein the power strip further comprises a network interface configured to communicatively connect the power strip to the server, and wherein the power strip is configured to transmit at least one of an alarm signal triggered by the changed electrical characteristic and an indication of the changed electrical characteristic to the server via the network interface.

15. The power strip according to claim 14, wherein the changed electrical characteristic includes a parallel capacitance measurement measurable via two pins of the power plug while the power plug is inserted into the socket-outlet.

16. The power strip according to claim 14, further comprising:

an alarm that is triggered based, at least in part, on the detected changed electrical characteristic.

17. The power strip according to claim 16, wherein the alarm is triggered based, at least in part, on the detected changed electrical characteristic as compared to a threshold value.

18. A power strip for use in an anti-theft security system for electrical appliances, the power strip comprising:

a socket-outlet configured to receive a power plug that is electrically connected to a power cord for an electrical appliance, wherein the power strip comprises an electronic circuit and memory, wherein the electronic circuit is configured to:

measure a first electrical characteristic of the power cord and/or the electrical appliance while the power plug is inserted into the socket-outlet to obtain a first measurement result;

store the first measurement result in the memory;

measure a second electrical characteristic of the power cord and/or the electrical appliance while the power plug is inserted into the socket-outlet to obtain a second measurement result; and compare the first measurement result with the second measurement result to detect a changed electrical characteristic; and a motion detector configured to detect movement of the power strip for triggering an alarm.

19. The power strip according to claim 18, wherein the alarm is triggered based, at least in part, on the detected changed electrical characteristic.

20. The power strip according to claim 19, wherein the alarm is triggered based, at least in part, on the detected changed electrical characteristic as compared to a threshold value.

21. A power strip for use in an anti-theft security system for electrical appliances, the power strip comprising:

a socket-outlet configured to measure electrical characteristics of a power cord and/or an electrical appliance, the socket-outlet further configured to receive a power plug that is electrically connected to a power cord for an electrical appliance, wherein the power strip comprises an electronic circuit and memory, wherein the electronic circuit, while the socket-outlet is in an unpowered mode, is configured to:

measure a first electrical characteristic of the power cord and/or the electrical appliance while the power plug is inserted into the socket-outlet to obtain a first measurement result;

store the first measurement result in the memory;

measure a second electrical characteristic of the power cord and/or the electrical appliance while the power plug is inserted into the socket-outlet to obtain a second measurement result; and compare the first measurement result with the second measurement result to detect a changed electrical characteristic.

22. The power strip according to claim 21, further comprising:

an alarm that is triggered based, at least in part, on the detected changed electrical characteristic.

23. The power strip according to claim 22, wherein the alarm is triggered based, at least in part, on the detected changed electrical characteristic as compared to a threshold value.

24. A power strip for use in an anti-theft security system for electrical appliances, the power strip comprising:

a socket-outlet configured to receive a power plug that is electrically connected to a power cord for an electrical appliance, wherein the power strip comprises an electronic circuit and memory, wherein the electronic circuit is configured to:

measure a first electrical characteristic of the power cord and/or the electrical appliance while the power plug is inserted into the socket-outlet to obtain a first measurement result;

store the first measurement result in the memory;

measure a second electrical characteristic of the power cord and/or the electrical appliance while the power plug is inserted into the socket-outlet to obtain a second measurement result; and compare the first measurement result with the second measurement result to detect a changed electrical characteristic, wherein the changed electrical characteristic includes an electromagnetic induction measurement measurable via two pins of the power plug while the power plug inserted into the socket-outlet.

25. The power strip according to claim 24, further comprising:

an alarm that is triggered based, at least in part, on the detected changed electrical characteristic.

26. The power strip according to claim 25, wherein the alarm is triggered based, at least in part, on the detected changed electrical characteristic as compared to a threshold value.

27. An anti-theft security system for electrical appliances, the security system comprising:

a power strip comprising:

a socket-outlet configured to receive a power plug that is electrically connected to a power cord for an electrical appliance, wherein the power strip comprises an electronic circuit and memory, wherein the electronic circuit is configured to:

measure a first electrical characteristic of the power cord and/or the electrical appliance while the power plug is inserted into the socket-outlet to obtain a first measurement result;

store the first measurement result in the memory;

measure a second electrical characteristic of the power cord and/or the electrical appliance while the power plug is inserted into the socket-outlet to obtain a second measurement result; and compare the first measurement result with the second measurement result to detect a changed electrical characteristic, wherein the changed electrical characteristic includes an electromagnetic induction measurement measurable via two pins of the power plug while the power plug is inserted into the socket-outlet; and a computer implemented server, wherein the power strip further comprises a network interface configured to communicatively connect the power strip to the server, and wherein the power strip is configured to transmit at least one of an alarm signal triggered by the changed electrical characteristic and an indication of the changed electrical characteristic to the server via the network interface.

28. The power strip according to claim 27, further comprising:

an alarm that is triggered based, at least in part, on the detected changed electrical characteristic.

29. The power strip according to claim 28, wherein the alarm is triggered based, at least in part, on the detected changed electrical characteristic as compared to a threshold value.

* * * * *